US011022107B2

(12) United States Patent
Brandt et al.

(10) Patent No.: US 11,022,107 B2
(45) Date of Patent: Jun. 1, 2021

(54) MICROPUMP WITH CAM MECHANISM FOR AXIAL DISPLACEMENT OF ROTOR

(71) Applicant: SENSILE MEDICAL AG, Olten (CH)

(72) Inventors: Derek Brandt, Sissach (CH); Thomas Wyss, Zuchwil (CH); Regina Marbet, Rütschelen (CH); Adrian Büchi, Zürich (CH); Alexandre Perrier, Liestal (CH)

(73) Assignee: SENSILE MEDICAL AG, Olten (CH)

( * ) Notice: Subject to any disclaimer, the term of this patent is extended or adjusted under 35 U.S.C. 154(b) by 0 days.

(21) Appl. No.: 16/771,244

(22) PCT Filed: Dec. 3, 2018

(86) PCT No.: PCT/EP2018/083390

§ 371 (c)(1),
(2) Date: Jun. 10, 2020

(87) PCT Pub. No.: WO2019/115276

PCT Pub. Date: Jun. 20, 2019

(65) Prior Publication Data

US 2021/0017969 A1 Jan. 21, 2021

(30) Foreign Application Priority Data

Dec. 12, 2017 (EP) ..... 17206732

(51) Int. Cl.
*F04B 9/04* (2006.01)
*F04B 7/06* (2006.01)
(Continued)

(52) U.S. Cl.
CPC ..... *F04B 9/042* (2013.01); *F04B 7/06* (2013.01); *F04B 17/03* (2013.01); *F04B 19/006* (2013.01); *F04B 43/043* (2013.01)

(58) Field of Classification Search
CPC ..... F04B 9/042; F04B 7/06; F04B 43/043; F04B 17/03; F04B 19/006
See application file for complete search history.

(56) References Cited

U.S. PATENT DOCUMENTS 7,726,955 B2 6/2010 Ryser et al.
7,798,783 B2 * 9/2010 Burns ..... F04B 7/06 417/53
(Continued)

FOREIGN PATENT DOCUMENTS

EP 1 677 859 7/2006
EP 1 803 934 7/2007
(Continued)

OTHER PUBLICATIONS

Written Opinion in International Application No. PCT/EP2018/083390, dated Jan. 30, 2019, pp. 1-10.

*Primary Examiner* — Charles G Freay
(74) *Attorney, Agent, or Firm* — Saliwanchik, Lloyd & Eisenschenk

(57) ABSTRACT

A micropump including: a stator (4); a rotor (6) slidably and rotatably mounted at least partially in the stator, the rotor comprising a first axial extension (24) having a first diameter (D1) and a second axial extension (26) having a second diameter (D2) greater than the first diameter; a first valve (V1) formed by a first valve seal (18) mounted on the stator around the first axial extension, in conjunction with a first channel (42) in the rotor that is configured to allow liquid communication across the first valve seal when the first valve is in an open position; a second valve (V2) formed by a second valve seal (20) mounted on the stator around the second axial extension, in conjunction with a second channel (44) in the rotor that is configured to allow liquid communication across the second valve seal when the second valve is in an open position; a pump chamber (8) formed between the rotor and stator and between the first valve seal and second valve seal, and a cam system comprising a cam track (22, 22') on one of the rotor or stator and a cam follower (36, 36') on the other of the rotor or stator for axially displacing the rotor relative to the stator as a function of the rotation of the rotor, the cam track comprising a valves-closed chamber-full section (28), a valves-closed chamber-empty section (30), an intake section (32) and an
(Continued)

expel section (34). The expel section comprises an expel hold position (34*b*) defining an intermediate axial position between the valves-closed chamber-full section and valves-closed chamber-empty section for partial delivery of a pump cycle volume during the expel phase.

22 Claims, 6 Drawing Sheets

(51) Int. Cl.

| | |
|---|---|
| ***F04B 17/03*** | (2006.01) |
| ***F04B 43/04*** | (2006.01) |
| ***F04B 19/00*** | (2006.01) |

(56) References Cited

U.S. PATENT DOCUMENTS

| | | | | |
|---|---|---|---|---|
| 8,282,366 | B2 * | 10/2012 | Hilber | F04B 51/00 417/420 |
| 9,222,470 | B2 | 12/2015 | Genoud et al. | |
| 9,416,775 | B2 * | 8/2016 | Focht | F04B 49/16 |
| 2016/0160854 | A1 * | 6/2016 | Dehan | F04B 53/14 417/494 |
| 2016/0369790 | A1 | 12/2016 | Yavorsky et al. | |

FOREIGN PATENT DOCUMENTS

| | | |
|---|---|---|
| EP | 2 275 678 | 1/2011 |
| EP | 2 962 714 | 1/2016 |
| WO | WO 2011/114285 | 9/2011 |

* cited by examiner

MICROPUMP WITH CAM MECHANISM FOR AXIAL DISPLACEMENT OF ROTOR

CROSS-REFERENCE TO RELATED APPLICATION

This application is the U.S. national stage application of International Patent Application No. PCT/EP2018/083390, filed Dec. 3, 2018.

TECHNICAL FIELD

The present invention relates to a micropump. The micropump may be used for dispensing small quantities of liquid, in particular for use in medical applications, for instance in a drug delivery device. A micropump related to the invention may also be used in non-medical applications that require high precision delivery of small quantities of liquid.

DESCRIPTION OF RELATED ART

A micropump for delivering small quantities of liquid that may in particular be used in medical and non-medical applications is described in EP1803934 and in EP1677859. The micropump described in the aforementioned documents includes a rotor with first and second axial extensions of different diameters that engage with first and second seals of the stator to create first and second valves that open and close liquid communication across the respective seal as a function of the angular and axial displacement of the rotor. A pump chamber is formed between the first and second seals of the stator whereby the pumped volume of liquid per rotation cycle of the rotor is a function of both the difference in diameters between the first and second rotor axial extensions and the axial displacement of the rotor that is effected by a cam system as a function of the angular position of the rotor with respect to the stator. The ability to control the pumped volume per cycle as a function of the rotary and axial displacement of the rotor but also the difference in diameters between the rotary extensions enables to pump very small quantities of liquid per revolution of the rotor with high accuracy. The minimum volume delivered by the above mentioned micropump corresponds to the maximum fill volume of the pump chamber.

Despite the small quantities that may be pumped accurately with the aforementioned known pumps, in certain applications the ability to dispense even smaller quantities of liquid in a well controlled manner would be a benefit.

The configuration of the cam system of the aforementioned known pumps may cause slight tilting of the rotor away which may affect the pump wear and precision, and cause unwanted vibration.

SUMMARY OF THE INVENTION

In view of the foregoing, an object of the invention is to provide a micropump able to dispense very small quantities of liquid in an accurate, reliable and safe manner.

It is advantageous to provide a micropump which is robust and very stable during operation.

It is advantageous to provide a micropump which is economical to manufacture.

It is advantageous to provide a micropump which is very compact.

It is advantageous to provide a micropump which may be provided with a low-cost disposable part and a reusable part which are easy to couple and use.

Objects of the invention are achieved by a micropump according to claim 1.

Objects of the invention are achieved by a micropump according to claim 11.

Disclosed herein is a micropump including a stator, a rotor slidably and rotatably mounted at least partially in the stator, the rotor comprising a first axial extension having a first diameter and a second axial extension having a second diameter greater than the first diameter, a first valve formed by a first valve seal mounted on the stator around the first axial extension, in conjunction with a first channel in the rotor that is configured to allow liquid communication across the first valve seal when the first valve is in an open position, a second valve formed by a second valve seal (20) mounted on the stator around the second axial extension, in conjunction with a second channel in the rotor that is configured to allow liquid communication across the second valve seal when the second valve is in an open position, a pump chamber formed between the rotor and stator and between the first valve seal and second valve seal, and a cam system comprising a cam track on one of the rotor or stator and a cam follower on the other of the rotor or stator for axially displacing the rotor relative to the stator as a function of the rotation of the rotor. The cam track comprises a valves-closed chamber-full section, a valves-closed chamber-empty section, an intake section and an expel section.

According to a first aspect of the invention, the expel section comprises an expel hold position defining an intermediate axial position between the valves-closed chamber-full section and valves-closed chamber-empty section for partial delivery of a pump cycle volume during the expel phase.

According to a second aspect of the invention, the cam system comprises a radially outer cam track and an associated radially outer cam follower, and a radially inner cam track and an associated radially inner cam follower, the radially outer cam track and radially inner cam track diametrically opposed to each other and defining the same cam profile developed over 360 degrees. Advantageously, the diametrically opposed cam tracks reduce the tilting moment on the rotor.

In an advantageous embodiment, the expel hold position comprises a plateau substantially orthogonal to an axis of rotation of the rotor.

In an advantageous embodiment, the plateau of the expel hold position extends over an angular arc of at least 15 degrees, preferably over an angular arc of at least 20 degrees.

In an advantageous embodiment, the cam follower comprises chamfered leading corners.

In an advantageous embodiment, the expel portion comprises expel ramp portions inclined at an angle ($\beta$) of less than 45 degrees relative to the valves-closed chamber-full and chamber-empty sections.

In an advantageous embodiment, the expel section comprises one or two expel hold positions at axial positions configured to divide the expel section into substantially equal subunits of a total axial displacement between a pump chamber-full position and a pump chamber-empty position.

In an embodiment, the pump module is coupled to a rotary drive comprising a stepper motor with stepper positions allowing the rotor to be stopped and held in expel hold positions intermediate the valves-closed chamber-full section and valves-closed chamber-empty section, the expel hold positions corresponding to integer multiples of the stepper positions.

In an advantageous embodiment, the cam track is mounted on a head of the rotor and the cam follower is mounted on the stator.

Further objects and advantageous features of the invention will be apparent from the claims, from the detailed description, and annexed drawings, in which:

DETAILED DESCRIPTION OF EXEMPLARY EMBODIMENTS

Figure 1:
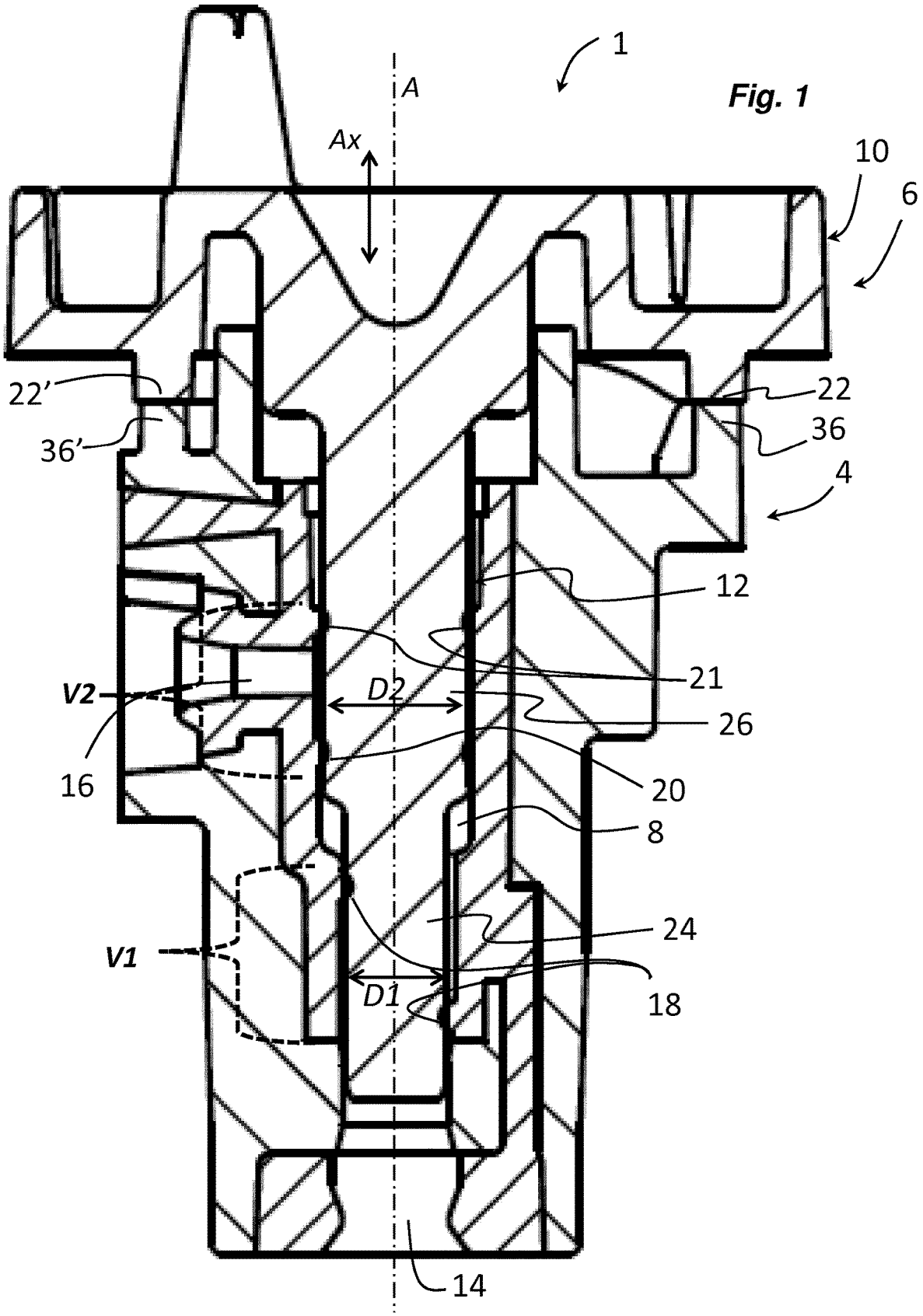
FIG. 1 is a cross-sectional view of a pump module (shown without motor drive and without liquid source and liquid outlet connection) according to an embodiment of the invention.
Figure 2A:
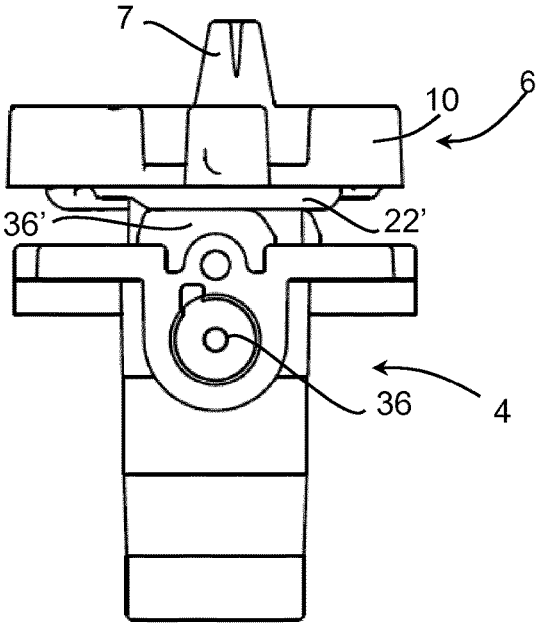
FIGS. 2*a* and 2*b* are side views from opposite sides of the pump module of FIG. 1 in a full pump chamber position.
Figure 2B:
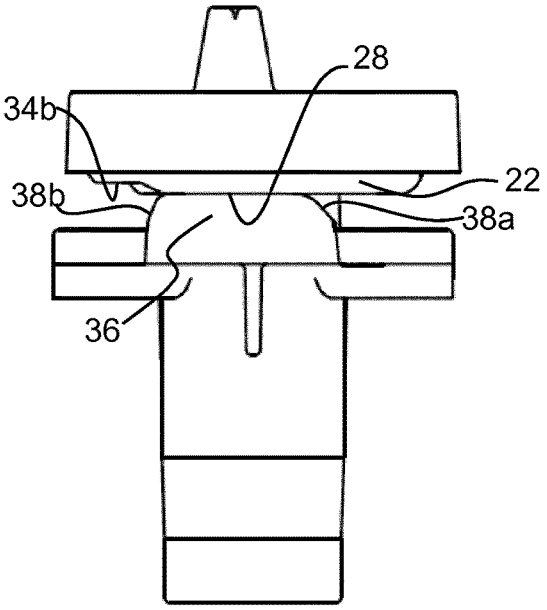
Figure 3A:
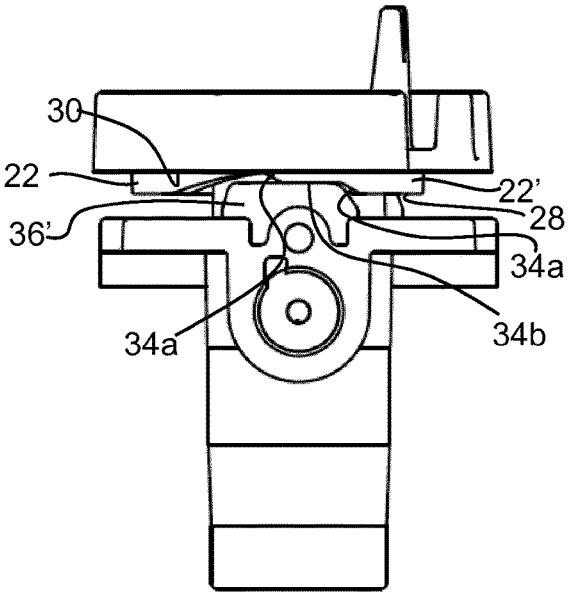
FIGS. 3*a* and 3*b* are side views from opposite sides of the pump module of FIG. 1 in an intermediate liquid expel position.
Figure 3B:
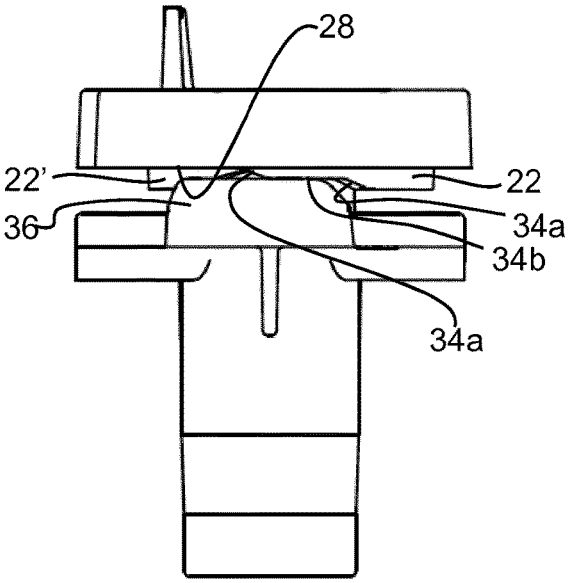

Referring to the figures, a micropump 1 includes a pump module 2 comprising a stator 4 and a rotor 6 driven by a rotary drive 3 comprising a motor 5 that imparts a rotational movement on the rotor about an axis of rotation A. The rotor 6 is biased axially, for instance by a spring 9, such that a camming system comprising a cam track 22, 22' on the rotor engaging a complementary cam follower 36, 36' on the stator imparts an axial displacement Ax of the rotor relative to the stator as a function of the angular position of the rotor as it turns. The axial and rotational displacement of the rotor relative to the stator causes first and second valves V1, V2, which will be described in more detail hereinafter, to open and close in order to effect a pumping action. This general functioning principal is per se known and described for instance in EP1803934.

In an embodiment, the rotary drive 3 may be in the form of a reusable part for coupling to the pump module 2 which may be in the form of a single use disposable part. For instance in drug delivery applications, the pump module may be integrated in a single use disposable part containing the liquid drug and liquid delivery outlet (such as a needle or catheter tube) and the rotary drive may be integrated in a reusable part including a power supply, control electronics and a user interface, whereby the reusable part may be coupled to the disposable part and then removed after use of the disposable part and recoupled to a new disposable part.

In an embodiment, the pump inlet 14 may be formed at an axial end of the rotor whereas an outlet 16 may be provided towards the end of the rotor comprising the cam. The outlet 16 may extend radially through the stator. The inlet and outlet may be inverted, depending on the rotational direction of the rotor relative to the stator and the valve seals configuration. Moreover, in certain embodiments, the pump may also be configured to be bidirectional whereby the direction of fluid flow depends on the direction of rotation of the rotor. The inlet or outlet formed at an axial end of the rotor may also be directed radially through the stator instead of axially from the end of the stator. The skilled person will appreciate that various fluid channels for the inlet and outlet may be configured according to the connection needs to fluid source and fluid delivery location without departing from the scope of the invention.

The rotor 6 has a first extension 24 having a first diameter D1, and a second extension 26 having a second diameter D2, the first and second diameters having different values. In the illustrated embodiment, the diameter D2 of the second extension 26 is larger diameter than the diameter D1 of the first extension 24. The difference in the first and second diameters coupled with the axial displacement Ax of the rotor defines a pumped volume per revolution of the rotor.

The micropump comprises a first valve V1 formed between the rotor first extension and the stator and a second valve V2 formed between the rotor second extension and the stator. The first and second valves V1, V2, control the opening and closing of the corresponding inlet 14 or outlet 16.

The first valve V1 is formed by a first valve seal 18 mounted on the stator and a first channel 42 mounted on the rotor that is configured to allow liquid communication across the first valve seal when the first valve seal is in an open position, and to not allow liquid communication across the first valve seal when the first valve V2 is in a closed position. The second valve V2 is formed by a second valve seal 20 on the stator 4 and a second channel 44 formed on the rotor 6 that allows liquid communication across the second valve seal when the second valve V2 is in an open position, and to not allow liquid communication across the second valve seal when the second valve V2 is in a closed position. Between the rotor 6 and stator 4 and between the first valve seal 18 and second valve seal 20, a pump chamber 8 is formed.

A pump chamber seal 21 circumscribes the second extension 26 and separates the pump chamber 8 from the pump external environment.

In the illustrated embodiments, the liquid channels 42, 44 are illustrated as grooves extending axially in their respective first and second rotor extensions 24, 26. In a variant however, other liquid channel configurations may be implemented, for instance the channel may not be a groove but buried within the rotor and having orifices on the rotor surface that allow communication across the corresponding seal. It may further be noted that the first valve seal 18 may have a different angular orientation with respective the second valve seal 20 such that the position of the rotor channel 44, 42 would be adapted accordingly.

The stator may be an injected component for instance an injected polymer with the seal being injected therein for instance in a two-step injection process. The seal may be injected in an elastomeric material as per se known in the art. The rotor 6 may also be injected polymer, the stator and rotor thus forming low cost disposable parts.

The volume of liquid pumped a full 360 degree revolution of the rotor 6 relative to the stator 4 is defined by the axial stroke of the rotor shaft 12 and the difference in the first and second diameters D1, D2. A small volume of liquid may be pumped in a pump cycle by providing a rotor shaft with a small difference in the first and second diameters. Nevertheless, the axial stroke of the rotor should have an amplitude sufficiently large to minimize the effects of manufacturing tolerances on the accuracy of the axial displacement. In certain applications, for instance for the administration of concentrated drugs or for the slow administration of a drug, there would be an advantage in delivering even smaller increments of liquid than administrated by a full revolution of the rotor shaft notwithstanding that micropumps according to embodiments of the invention may be provided to accurately pump quantities as small as two microliters per cycle.

The axial displacement of the rotor 6 as a function of the angular displacement of the rotor is imposed by an axial displacement system comprising a biasing mechanism 9 and a cam system. The cam system comprises a cam track 22, 22' and a cam follower 36, 36' biased against the cam track by the biasing mechanism. In the illustrated embodiment, the cam track 22, 22' is provided on the rotor head 10 whereas the cam protrusion 36, 36' is provided on the stator 4. It may be appreciated however that the functions of cam track and cam protrusion may be inverted such that the cam protrusion is on a rotor and the cam track on the stator without departing from the scope of the invention.

Figure 5:
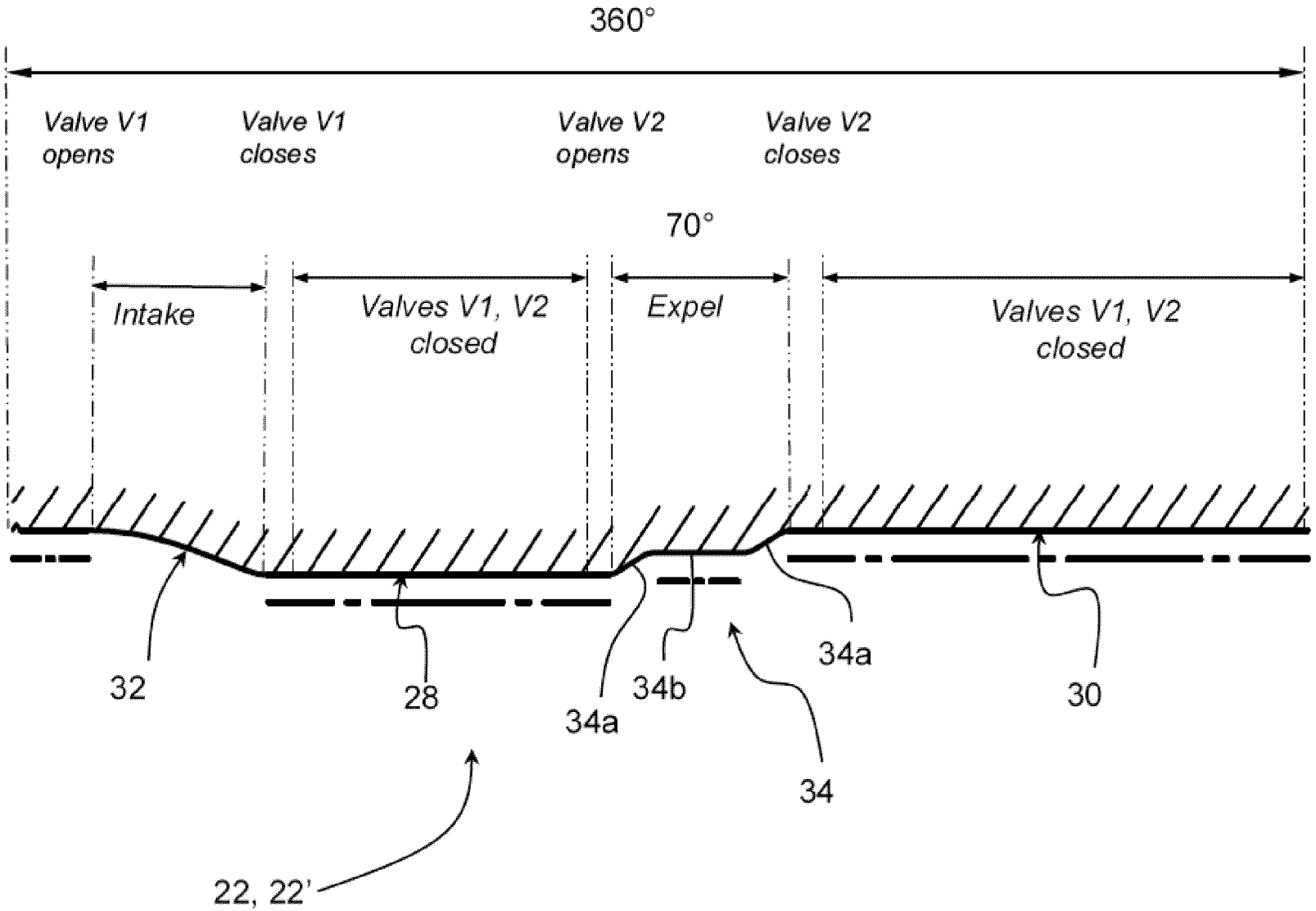
FIG. 5 is a schematic view of a developed cam track of a cam system for axial displacement of the rotor relative to the stator of a micropump according to an embodiment of the invention.

The cam track 22, 22' defines the axial position of the rotor relative to the stator as a function of the angular position of the rotor relative to the stator. The axial displacement of the rotor is thus a function of the rotational displacement of the rotor, defined by the profile of the cam track. FIG. 5 illustrates an example of a 360° developed profile of a cam track 22, 22' according to an embodiment of the invention.

Figure 4A:
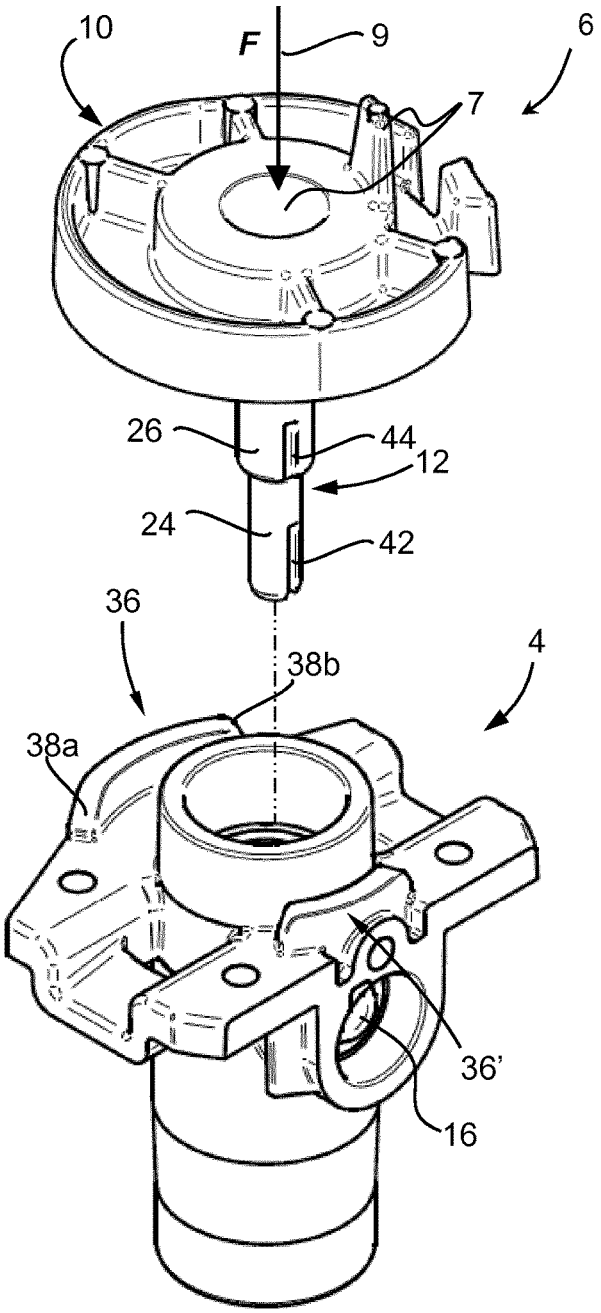
FIG. 4*a* is a perspective view of the pump module of FIG. 1 showing the rotor disassembled from the stator.
Figure 4B:
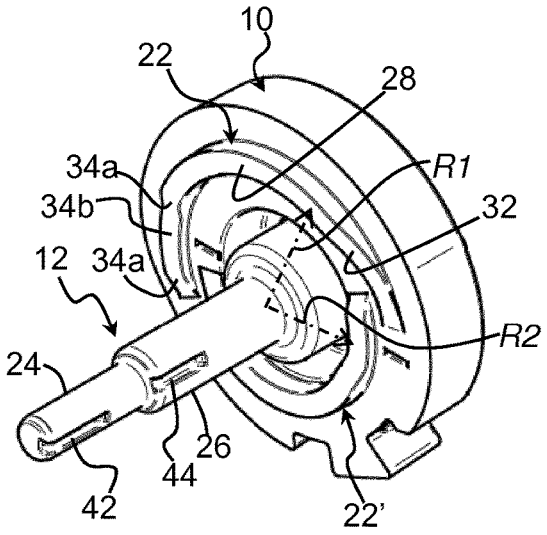
FIG. 4*b* is a perspective view of the rotor of the pump module of FIG. 4*a;*
Figure 4C:
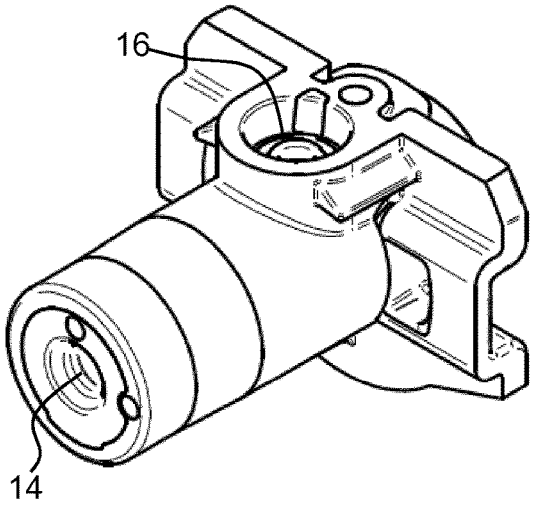
FIG. 4*c* is a perspective view of the stator of the pump module of FIG. 4*a;*

As best seen in FIG. 4*b*, the cam system may comprise a pair of cam tracks and a corresponding pair of cam followers 36, 36. There is a radially outer cam track 22 having a radius of curvature R1 and a radially inner cam track 22' having a radius of curvature R2, whereby R2 is smaller than R1. A first cam followers 36 is positioned to engage the radially outer cam track 22 and a second cam followers 36' is positioned to engage the radially inner cam track 22'. The radially outer and radially inner cam tracks may define, in conjunction with the corresponding pair of cam followers 36, 36', substantially identical axial displacement profiles as a function of the angular displacement of the rotor. The concentric radial positions of the radially inner and radially outer cam tracks ensures that the radially outer cam protrusion 36 engages only the radially outer cam track 22 and the radially inner cam protrusion 36' engages only the radially inner cam track 22'.

In a preferred embodiment, the radially inner cam track is diametrically opposed to the radially outer cam track whereby the pair of cam tracks engaging the corresponding pair of cam followers increases the stability of the rotor 6. In particular, the biasing force F applied by the biasing mechanism 9 on the rotor generates a resulting force that is aligned with the rotor axis A and thus offset from the reaction force of the cam follower on the corresponding cam track. This offset force generates a moment that will tend to tilt the rotor thus leading to increased friction and possibly vibration that are undesirable. The pair of cam tracks 22, 22' and corresponding cam followers 36, 36' provides a pair of diametrically opposed cam contact points that significantly reduce the tilting moment on the rotor thus improving stability, and reducing potential problems of vibration and wear.

It may however be noted within the scope of the invention that the cam system may comprise more than two cam tracks, for instance three or four cam tracks and three, respectively four associated cam followers, each defining a substantially identical profiles developed over 360°, with the purpose of providing a plurality of rotor support points to reduce tilting of the rotor. The various cam tracks can be on different radiuses such that each cam follower only engages one associated cam track. The cam tracks and cam followers may be angularly spaced apart evenly around the rotor axis (for instance every 120° for three cam tracks).

Referring in particular to FIG. 5, the cam track 22, 22' profile comprises an intake section 32 in a form of a ramp that extends from a valves-closed chamber-empty section 30 to a valves-closed chamber-full section 28. Engagement of the intake section 32 with the cam follower thus causes an axial displacement of the rotor while the inlet valve V1 is open and outlet valve V2 is closed in order to fill the pump chamber 8. Once the pump chamber 8 is full, the inlet valve V1 closes and the outlet valve V2 remains closed over a certain angular range before the expel phase of the pump cycle. Both inlet and outlet valves are thus closed over a defined angular range in order to ensure the inlet and outlet valves may never both be open simultaneously, thus preventing a situation of liquid passing through the pump when the pump rotor is stationary. At the beginning of the expel phase, the outlet valve V2 opens while the inlet valve V1 remains closed and the expel section 34 of the cam track engages the cam follower. The expel section 34 comprises expel ramp portions 34*a* that cause an axial displacement of the rotor from the valves-closed chamber-full section 28 to the valves-closed chamber-empty section 30.

According to an aspect of the invention, the expel section 34 is provided with and at least one expel hold position 34. The expel hold position 34*b* is positioned at an intermediate angular and axial position between the valves-closed chamber-full section 28 and valves-closed chamber-empty section 30 and allows the rotor 6 to be stopped and held stably at the intermediate position.

In the embodiment illustrated in FIG. 5, the delivery of liquid may thus be split into two partial delivery stages in order to administer the full volume of a pump cycle in two partial delivery increments.

Figure 6A:
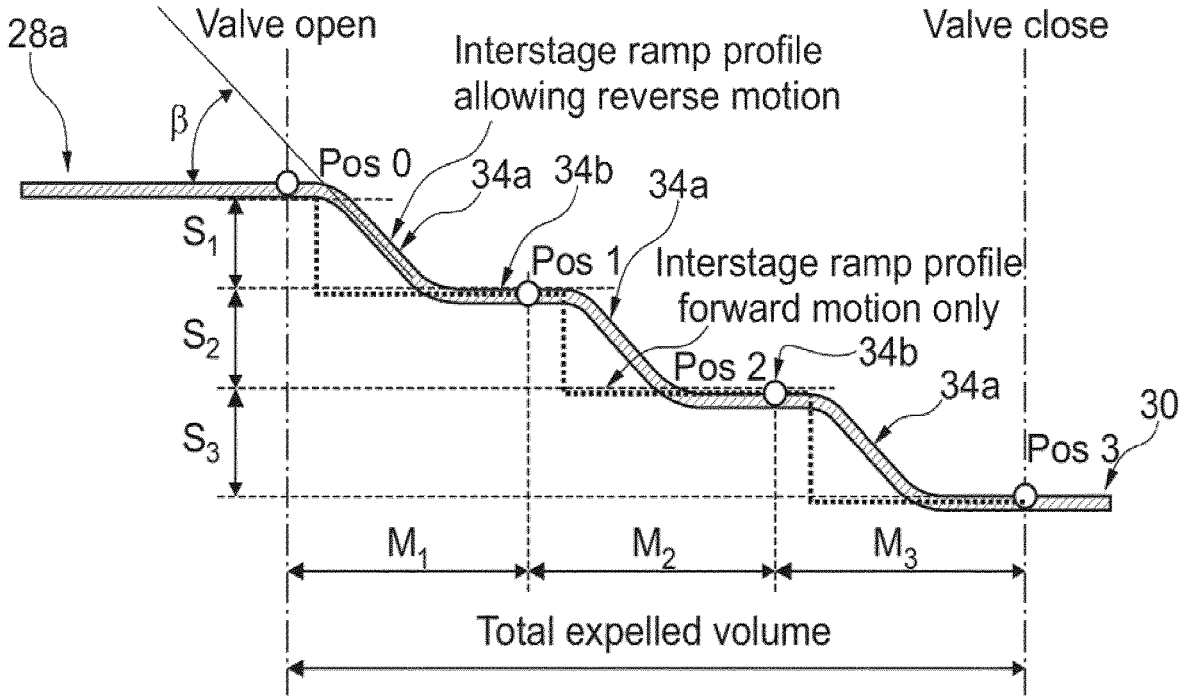
FIGS. 6*a* and 6*b* are schematic views of a developed cam track profile of a cam system for axial displacement of the rotor relative to the stator of a micropump according to another embodiment of the invention.
Figure 6B:
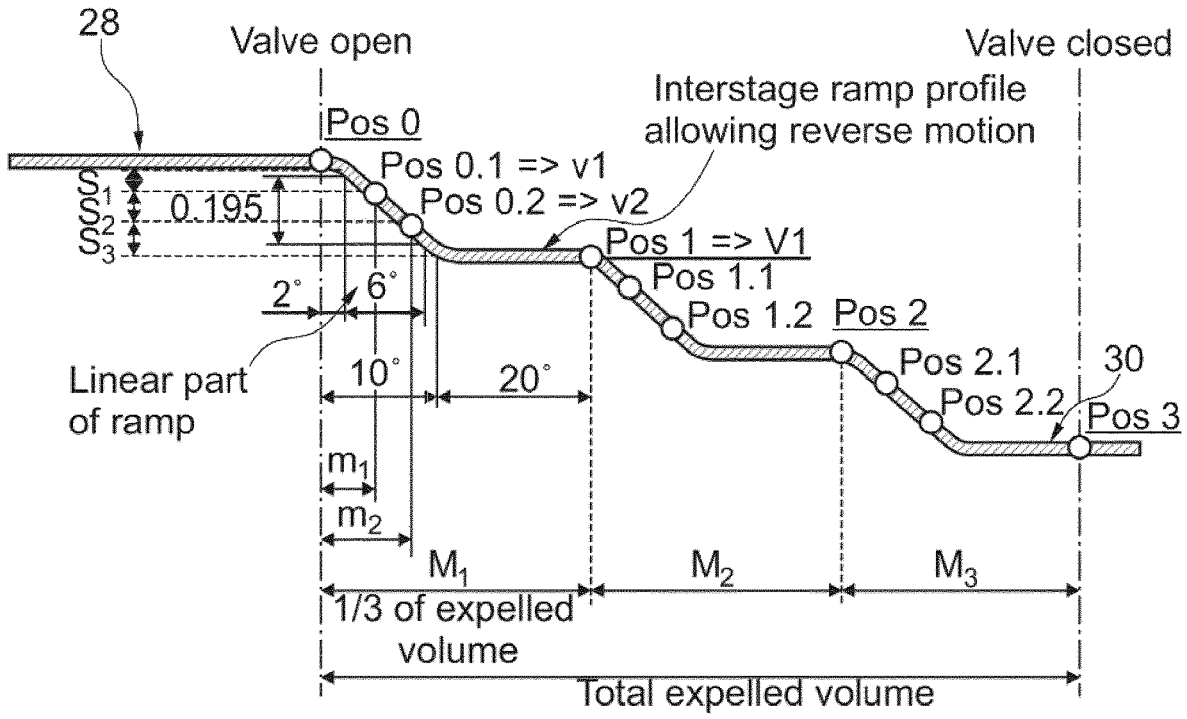

In variants, two or more expel hold positions may be provided to administer the full volume of a pump cycle in three or more partial delivery increments. As illustrated in the example of FIGS. 6*a* and 6*b*, the expel section of the cam track is provided with two expel hold positions 34*b* separated by expel ramp portions 34*a* thus defining three partial delivery increments of the total expelled volume for a pump cycle.

Advantageously, the expel section 34 provided with one or more expel hold positions 34*b* to deliver accurately and reliably portions of the full pump cycle volume in stages, allows to deliver very small volume doses of liquid in increments over time. Operating the micropump in stages of partial delivery of a full pump cycle may be particularly useful to control the rate of administration of a liquid drug over a span of time. This allows for instance to simulate controlled slow quasi-continuous delivery of a drug (e.g. to deliver a basal rate). Such partial delivery of a pump cycle volume may also be useful for a very accurate delivery of precise quantities of liquid, for instance corresponding to multiple pump cycles plus a portion of a pump cycle. For instance, if the full pump cycle delivery volume is 2 μl, and the cam track has one expel hold position 34*b* axially midway between the valves-closed chamber-full section 28 and valves-closed chamber-empty section 30 as illustrated in FIG. 5 (i.e. two partial delivery stages), a volume corresponding to an odd integer may be delivered. For instance in order to deliver 7 μl, the pump may be operated to deliver 3.5 pump cycle volumes by rotating the rotor three times and then stopping the rotor when the cam follower engages the expel hold position 34*b* during the fourth rotation.

In advantageous embodiments, the expel hold position 34*b* may comprise a plateau that defines a surface that is essentially orthogonal to the axis of rotation A. The angular arc length of the expel hold portion 34*b* may advantageously extend over at least 15 degrees in order to provide an accurate intermediate axial position (which defines the expelled volume) with some tolerance for the angular stop position of the rotor relative to the stator.

In a variant, the expel ramp portion 34*a* may be configured with a slope that allows the reverse rotation of the rotor relative to the stator (reverse rotation being opposite to forward rotation corresponding to the normal pumping operation). Reverse rotation of the rotor may be useful for special operations of the pump including bidirectional flow for drug reconstitution, reverse rotor movement for actuating retraction of a needle of a drug delivery device, or other special operations. The slope of the expel ramp portions 34*a* preferably have an angle β relative to the valves-closed chamber-full section 28 or valves-closed chamber-empty section 30 of around 45 degrees or less. Nevertheless, in a variant, in which a reverse rotation of the rotor is not provided, the expel ramp portions 34*a* may have angles with respect to the chamber-full and chamber-empty sections 28, 30 of between 45 and 90 degrees.

The cam follower 36, 36' may advantageously be provided with a chamfered forward leading corner 38*a*, and for variants allowing reverse rotation a chamfered reverse leading corner 38*b*, to ensure a smooth transition of the cam follower 36, 36' on the associated cam track 22, 22' when progressing from plateaus defined by the valves-closed chamber-full and chamber empty sections 28, 30 and expel hold positions 34*b*, to subsequent ramp portions.

The diametrically opposed cam followers 36, 36' and associated diametrically opposed cam tracks 22, 22' may be provided with identical engaging profiles when develop over the 360 degrees of a rotation, adjusted for the radius of curvature R1, R2.

Figure 7:
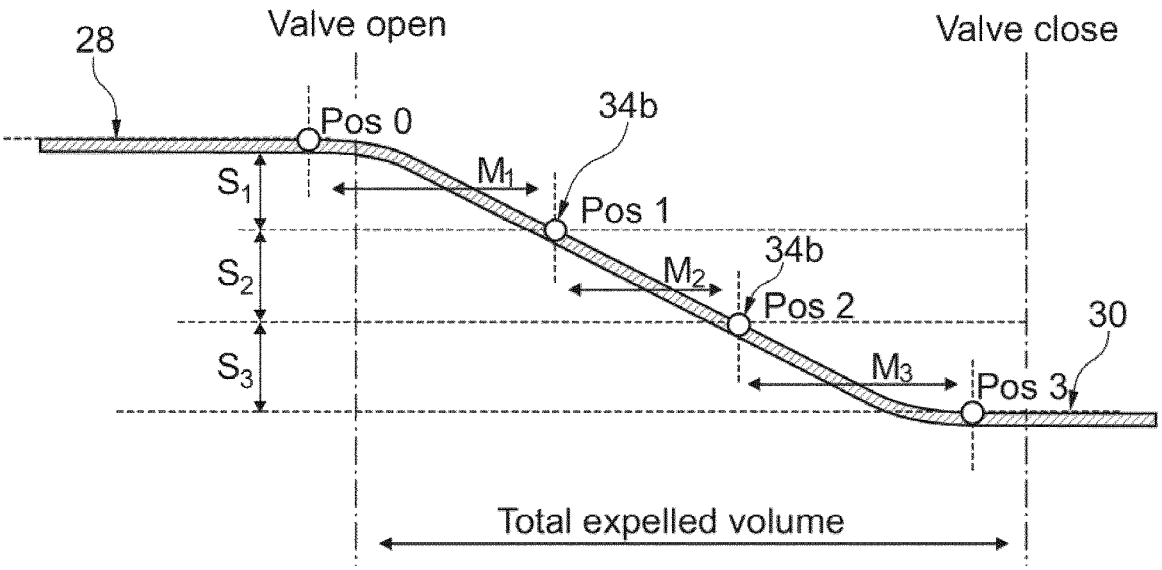
FIG. 7 is a schematic view of a developed cam track profile of a cam system for axial displacement of the rotor relative to the stator of a micropump according to yet another embodiment of the invention.
Figure 8:
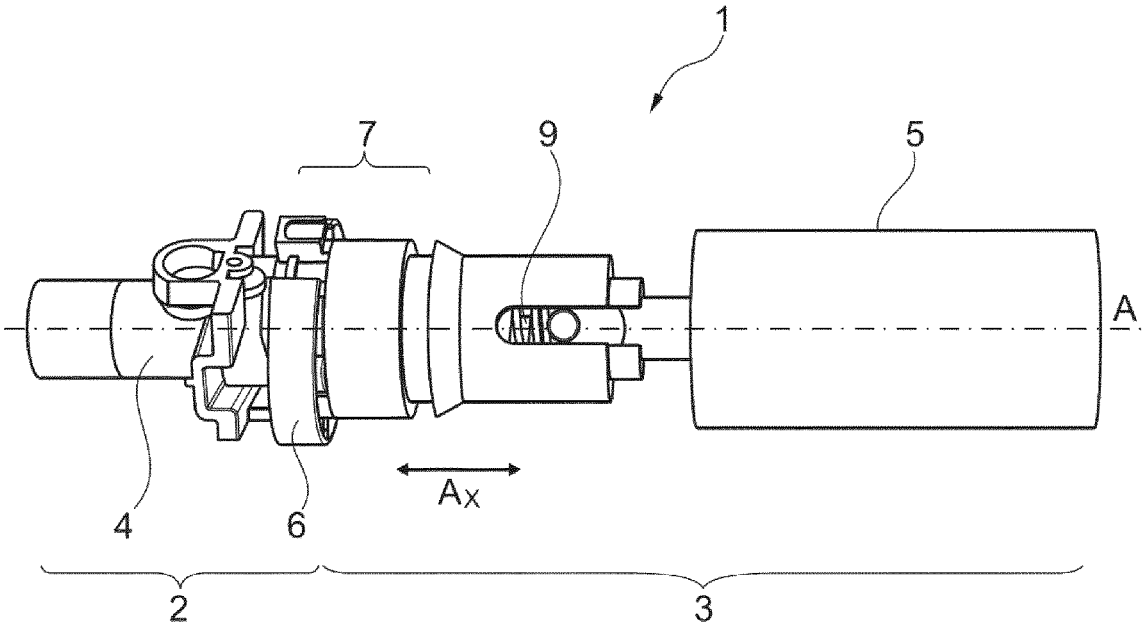
FIG. 8 is a view illustrating a micropump according to an embodiment of the invention.

In embodiments of the invention, the motor 5 of the rotary drive 3 may advantageously be in a form of a stepper motor comprising steps that are angularly separated by increments that are smaller than the angular range of the expel section 34 of the cam track 22. The rotor 6 engaged by the stepper motor may be stopped at selected steps of the stepper motor in order to stop and hold the rotor while the cam follower is engaged along the expel section of the cam track. Thus, for instance, as illustrated in FIG. 7, one or more intermediate expel hold positions 34*b* may be defined by steps of the motor to deliver portions of the full volume of a pump cycle. It may be noted that the stepper motor and any reduction gear system between the stepper motor and the rotor 6 may comprise a plurality of positions between the defined expel hold positions 34*b*. The rotary drive may comprise a stroke sensor (not shown) for measuring the axial displacement of the rotor 6 relative to the stator. The stroke sensor may comprise an optical or magnetic position sensor, or other known position sensors, per se well known in the art of position sensing. The stroke sensor may be connected to the control electronics of the rotary drive in order to control the stepper motor, in particular to stop at the selected expel hold positions. The stroke sensor may also serve to detect faulty operation the micropump.

In a variant, the micropump may comprise a combination of the expel hold positions 34*b* comprising plateaus, and the control of a stepper motor in the rotary drive of the micropump to define further intermediate expel hold positions.

LIST OF FEATURES ILLUSTRATED

- Micropump 1
  - Pump module 2 (disposable part)
- Stator 4
  - Inlet 14
  - Outlet 16
  - First valve V1
    - First valve seal 18
  - Second valve V2
    - Second valve seal 20
  - Pump chamber seal 21
  - Cam system
    - Cam follower 36, 36'
- Rotor 6
  - Rotor head 10
    - Transmission input coupling
    - Cam system
      - Cam track 22, 22'
        - Radially outer cam track 22
          - Radius of curvature R1
        - Radially inner cam track 22'
          - Radius of curvature R2
        - (R2<R1)
  - Rotor shaft 12
    - First extension (having a first diameter D1) 24
      - First channel 42
    - Second extension (having a second diameter D2) 26
- Second channel 44
- Pump chamber 8
- Axial displacement system
  - Biasing mechanism 9
  - Cam track 22, 22'
    - Valves-closed chamber-full section 28
    - Valves-closed chamber-empty section 30
    - Intake section 32
    - Expel section 34
      - Expel ramp portion 34*a*
      - Expel hold portion 34*b*
  - Cam follower 36, 36'
    - Leading corner 38*a*, 38*b*
- Rotary Drive 3 (reusable part)
  - Motor 5
    - Stepper motor
  - Coupling 7
  - Biasing mechanism 9
  - Stroke sensor

The invention claimed is:

1. A micropump including a stator, a rotor slidably and rotatably mounted at least partially in the stator, the rotor comprising a first axial extension having a first diameter and a second axial extension having a second diameter greater than the first diameter, a first valve formed by a first valve seal mounted on the stator around the first axial extension, in conjunction with a first channel in the rotor that is configured to allow liquid communication across the first valve seal when the first valve is in an open position, a second valve formed by a second valve seal mounted on the stator around the second axial extension, in conjunction with a second channel in the rotor that is configured to allow liquid communication across the second valve seal when the second valve is in an open position, a pump chamber formed between the rotor and stator and between the first valve seal and second valve seal, and a cam system comprising a cam track on one of the rotor or stator and a cam follower on the other of the rotor or stator for axially displacing the rotor relative to the stator as a function of the rotation of the rotor, the cam track comprising a valves-closed chamber-full section, a valves-closed chamber-empty section, an intake section and an expel section, wherein the expel section comprises an expel hold position defining an intermediate axial position between the valves-closed chamber-full section and valves-closed chamber-empty section for partial delivery of a pump cycle volume during an expel phase.

2. The micropump according to claim 1, wherein the expel hold position comprises a plateau substantially orthogonal to an axis of rotation of the rotor.

3. The micropump according to claim 2, wherein the plateau of the expel hold position extends over an angular arc of at least 15 degrees.

4. The micropump according to claim 3, wherein the plateau of the expel hold position extends over an angular arc of at least 20 degrees.

5. The micropump according to claim 1, wherein the cam follower comprises chamfered leading corners.

6. The micropump according to claim 1, wherein the expel section comprises expel ramp portions inclined at an angle (β) of less than 45 degrees relative to the valves-closed chamber-full section and valves-closed chamber-empty section.

7. The micropump according to claim 1, wherein the expel section comprises one or two expel hold positions at axial positions configured to divide the expel section into substantially equal subunits of a total axial displacement between a pump chamber-full position and a pump chamber-empty position.

8. The micropump according to claim 1, wherein the rotor is coupled to a rotary drive comprising a stepper motor with stepper positions allowing the rotor to be stopped and held in expel hold positions intermediate the valves-closed chamber-full section and the valves-closed chamber-empty section, the expel hold positions corresponding to integer multiples of the stepper positions.

9. The micropump according to claim 1, wherein the cam track is mounted on a head of the rotor and the cam follower is mounted on the stator.

10. The micropump according to claim 9, wherein the cam system comprises at least two cam tracks and associated cam followers, including a radially outer cam track and an associated radially outer cam follower, and a radially inner cam track and an associated radially inner cam follower, the radially outer cam track and radially inner cam track diametrically opposed to each other and defining the same cam profile developed over 360 degrees.

11. The micropump according to claim 10, wherein the cam system comprises two cam tracks, the radially outer cam track and radially inner cam track being diametrically opposed to each other.

12. A micropump including a stator, a rotor slidably and rotatably mounted at least partially in the stator, the rotor comprising a first axial extension having a first diameter and a second axial extension having a second diameter greater than the first diameter, a first valve formed by a first valve seal mounted on the stator around the first axial extension, in conjunction with a first channel in the rotor that is configured to allow liquid communication across the first valve seal when the first valve is in an open position, a second valve formed by a second valve seal mounted on the stator around the second axial extension, in conjunction with a second channel in the rotor that is configured to allow liquid communication across the second valve seal when the second valve is in an open position, a pump chamber formed between the rotor and stator and between the first valve seal and second valve seal, and a cam system comprising a cam track on one of the rotor or stator and a cam follower on the other of the rotor or stator for axially displacing the rotor relative to the stator as a function of the rotation of the rotor, the cam track comprising a valves-closed chamber-full section, a valves-closed chamber-empty section, an intake section and an expel section, wherein the cam system comprises at least two cam tracks and associated cam followers, including a radially outer cam track and an associated radially outer cam follower, and a radially inner cam track and an associated radially inner cam follower, the radially outer cam track and radially inner cam track defining the same cam profile developed over 360 degrees.

13. The micropump according to claim 12, wherein the cam system comprises two cam tracks, the radially outer cam track and the radially inner cam track being diametrically opposed to each other.

14. The micropump according to claim 12, wherein the expel section comprises an expel hold position defining an intermediate axial position between the valves-closed chamber-full section and the valves-closed chamber-empty section for partial delivery of a pump cycle volume during an expel phase.

15. The micropump according to claim 14, wherein the expel hold position comprises a plateau substantially orthogonal to an axis of rotation of the rotor.

16. The micropump according to claim 15, wherein the plateau of the expel hold position extends over an angular arc of at least 15 degrees.

17. The micropump according to claim 16, wherein the plateau of the expel hold position extends over an angular arc of at least 20 degrees.

18. The micropump according to claim 12, wherein the cam follower comprises chamfered leading corners.

19. The micropump according to claim 12, wherein the expel section comprises expel ramp portions inclined at an angle (β) of less than 45 degrees relative to the valves-closed chamber-full and chamber-empty sections.

20. The micropump according to claim 12, wherein the expel section comprises one or two expel hold positions at axial positions configured to divide the expel section into substantially equal subunits of a total axial displacement between a pump chamber-full position and a pump chamber-empty position.

21. The micropump according to claim 12, wherein the rotor is coupled to a rotary drive comprising a stepper motor with stepper positions allowing the rotor to be stopped and held in expel hold positions intermediate the valves-closed chamber-full section and the valves-closed chamber-empty section, the expel hold positions corresponding to integer multiples of the stepper positions.

22. The micropump according to claim 12, wherein the cam track is mounted on a head of the rotor and the cam follower is mounted on the stator.

* * * * *